United States Patent [19]

Lacy

[11] 4,380,338

[45] Apr. 19, 1983

[54] GOLF GAME

[76] Inventor: Jesse H. Lacy, P.O. Box 109, Moss Point, Miss. 39563

[21] Appl. No.: 207,360

[22] Filed: Nov. 17, 1980

[51] Int. Cl.[3] ..... A63F 3/00

[52] U.S. Cl. ..... 273/245

[58] Field of Search ..... 273/245, 87, 247

[56] References Cited

U.S. PATENT DOCUMENTS

| | | | |
|---|---|---|---|
| 1,541,202 | 6/1925 | Winbigler | 273/245 |
| 1,758,581 | 5/1930 | Morch | 273/245 |
| 3,658,339 | 4/1972 | Boileau | 273/245 |

FOREIGN PATENT DOCUMENTS

| | | | |
|---|---|---|---|
| 362587 | 12/1931 | United Kingdom | 273/245 |

OTHER PUBLICATIONS

John Scarne, *Scarne's Encyclopedia of Game*, c. 1973, pp. 483, 484.

*Primary Examiner*—Richard C. Pinkham
*Assistant Examiner*—Scott Brown
*Attorney, Agent, or Firm*—Cushman, Darby & Cushman

[57] ABSTRACT

A golf game including a board carrying a pictorial representation of an 18 hole golf course, shot charts for indicating various positions on each golf hole and a chance selection device (such as a die) for advancing the golf ball along the course. A first set of three charts respectively correlates various positional changes on respective par 3, par 4 and par 5 holes to rolls of a die. A second set of 18 charts, respectively corresponding to play on individual holes, permits the player, at his option, to alter his shots by reference these charts following a second roll of the die.

6 Claims, 9 Drawing Figures

| Par 3 | ROLL OF DICE 1 | 2 | 3 | 4 | 5 | 6 |
|---|---|---|---|---|---|---|
| TEE SHOTS | TRAP | GREEN 10 FT. | GREEN 30 FT. | WATER | SHORT | GREEN 20 FT. |
| APPROACH SHOTS | GREEN 30 FT. | GREEN 10 FT. | GREEN 20 FT. | GREEN 10 FT. | GREEN 10 FT. | GREEN 20 FT. |
| TRAP SHOTS | GREEN 10 FT. | GREEN 20 FT. | GREEN 20 FT. | GREEN 30 FT. | GREEN 10 FT. | GREEN 20 FT. |
| PUTTS 10 FOOT | 1 PUTT | 2 PUTT | 1 PUTT | 2 PUTT | 1 PUTT | 2 PUTT |
| PUTTS 20 FOOT | 3 PUTT | 2 PUTT | 2 PUTT | 2 PUTT | 1 PUTT | 1 PUTT |
| PUTTS 30 FOOT | 2 PUTT | 2 PUTT | 1 PUTT | 2 PUTT | 2 PUTT | 3 PUTT |

Fig. 2b.
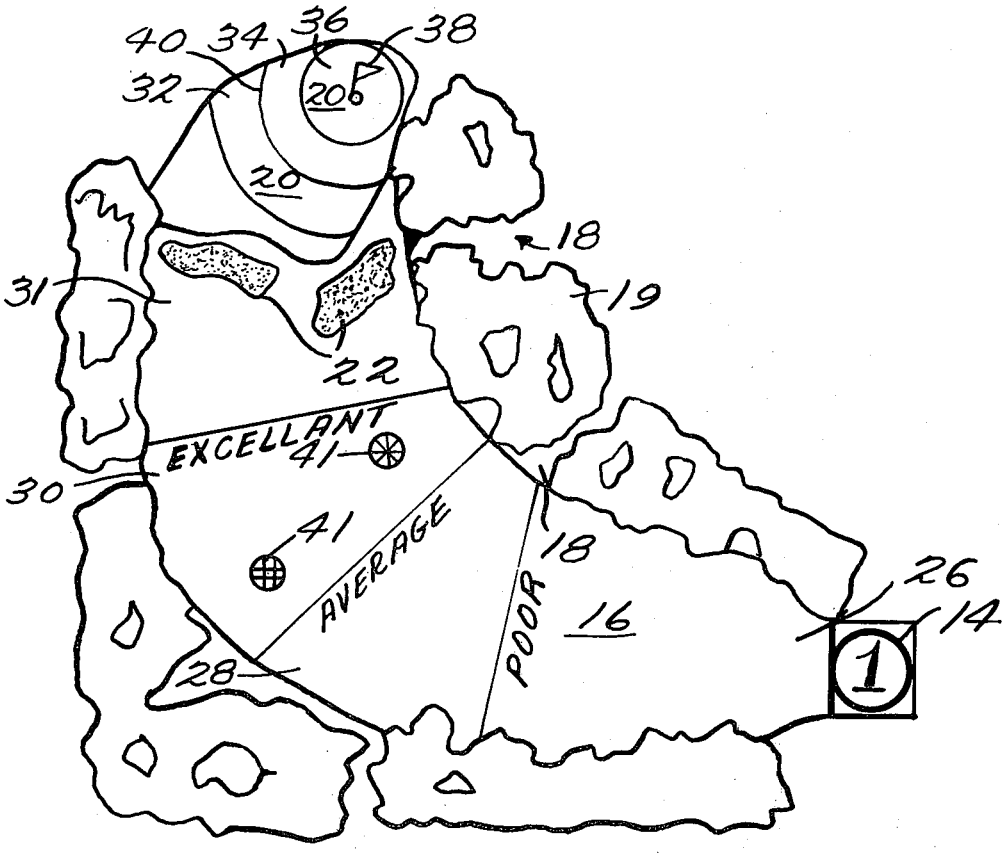
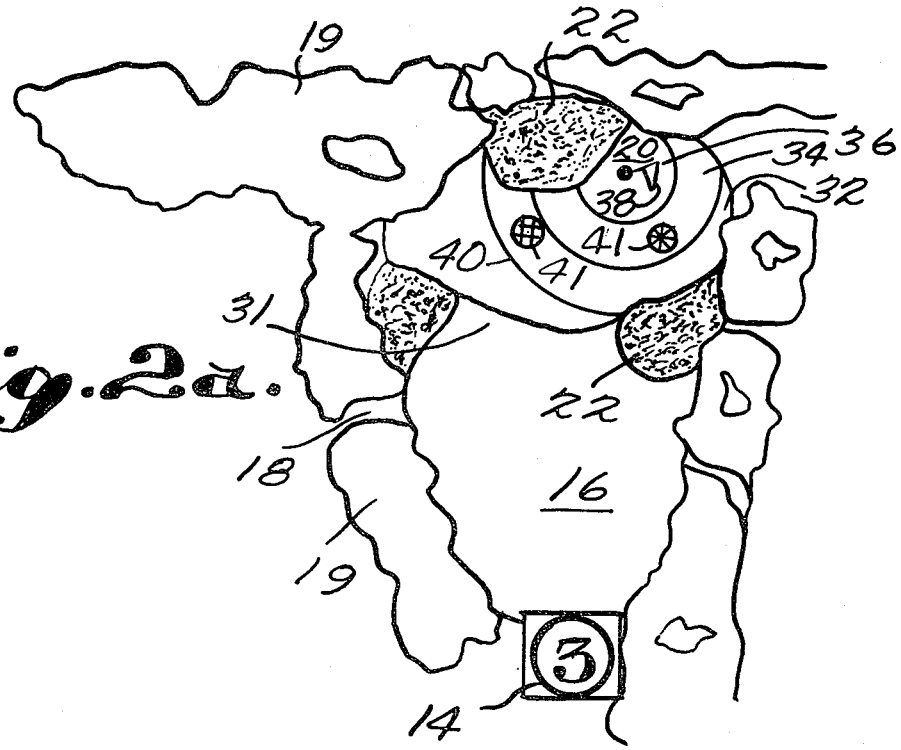
Fig. 2a.

Fig. 3a.

44

| Par 3 | | ROLL OF DICE | | | | | |
|---|---|---|---|---|---|---|---|
| | | 1 | 2 | 3 | 4 | 5 | 6 |
| TEE SHOTS | | TRAP | GREEN 10 FT. | GREEN 30 FT. | WATER | SHORT | GREEN 20 FT. |
| APPROACH SHOTS | | GREEN 30 FT. | GREEN 10 FT. | GREEN 20 FT. | GREEN 10 FT. | GREEN 10 FT. | GREEN 20 FT. |
| TRAP SHOTS | | GREEN 10 FT. | GREEN 20 FT. | GREEN 20 FT. | GREEN 30 FT. | GREEN 10 FT. | GREEN 20 FT. |
| PUTTS | 10 FOOT | 1 PUTT | 2 PUTT | 1 PUTT | 2 PUTT | 1 PUTT | 2 PUTT |
| | 20 FOOT | 3 PUTT | 2 PUTT | 2 PUTT | 2 PUTT | 1 PUTT | 1 PUTT |
| | 30 FOOT | 2 PUTT | 2 PUTT | 1 PUTT | 2 PUTT | 2 PUTT | 3 PUTT |

62 72 50 64

Fig. 3b.

46

| Par 4 | | ROLL OF DICE | | | | | |
|---|---|---|---|---|---|---|---|
| | | 1 | 2 | 3 | 4 | 5 | 6 |
| DRIVE | | AVERAGE | AVERAGE | EXCELLENT | POOR | AVERAGE | EXCELLENT |
| SECOND SHOTS | FOR POOR DRIVES | TRAP | TRAP | GREEN 30 FT. | SHORT | SHORT | WATER |
| | FOR AVERAGE DRIVES | TRAP | GREEN 10 FT. | GREEN 30 FT. | GREEN 30 FT. | GREEN 20 FT. | WATER |
| | FOR EXCELLENT DRIVES | GREEN 20 FT. | GREEN 30 FT. | GREEN 10 FT. | GREEN 20 FT. | TRAP | GREEN 30 FT. |
| APPROACH SHOTS | | GREEN 30 FT. | GREEN 20 FT. | GREEN 10 FT. | GREEN 20 FT. | GREEN 10 FT. | GREEN 20 FT. |
| TRAP SHOTS | | GREEN 30 FT. | GREEN 10 FT. | GREEN 20 FT. | GREEN 20 FT. | GREEN 20 FT. | GREEN 10 FT. |
| PUTTS | 10 FOOT | 1 PUTT | 2 PUTT | 1 PUTT | 2 PUTT | 2 PUTT | 1 PUTT |
| | 20 FOOT | 2 PUTT | 2 PUTT | 1 PUTT | 1 PUTT | 2 PUTT | 3 PUTT |
| | 30 FOOT | 3 PUTT | 1 PUTT | 2 PUTT | 2 PUTT | 2 PUTT | 2 PUTT |

72 52 58 56

Fig. 3c.

48

| Par 5 | | ROLL OF DICE | | | | | |
|---|---|---|---|---|---|---|---|
| | | 1 | 2 | 3 | 4 | 5 | 6 |
| DRIVE | | POOR | EXCELLENT | AVERAGE | AVERAGE | AVERAGE | EXCELLENT |
| SECOND SHOTS | FOR POOR DRIVES | GREEN 30 FT. | SHORT | SHORT | TRAP | SHORT | WATER |
| | FOR AVERAGE DRIVES | SHORT | GREEN 30 FT. | SHORT | WATER | TRAP | GREEN 20 FT. |
| | FOR EXCELLENT DRIVES | GREEN 30 FT. | TRAP | GREEN 20 FT. | WATER | GREEN 10 FT. | SHORT |
| APPROACH SHOTS | | SHORT | GREEN 20 FT. | GREEN 30 FT. | GREEN 20 FT. | GREEN 10 FT. | GREEN 20 FT. |
| TRAP SHOTS | | GREEN 20 FT. | GREEN 10 FT. | GREEN 10 FT. | GREEN 20 FT. | GREEN 30 FT. | GREEN 30 FT. |
| PUTTS | 10 FOOT | 2 PUTT | 1 PUTT | 1 PUTT | 2 PUTT | 2 PUTT | 1 PUTT |
| | 20 FOOT | 1 PUTT | 2 PUTT | 2 PUTT | 1 PUTT | 2 PUTT | 3 PUTT |
| | 30 FOOT | 3 PUTT | 1 PUTT | 2 PUTT | 2 PUTT | 2 PUTT | 2 PUTT |

72 54

66

Fig. 4.

1st hole

1st roll was
1 – repeat of 1 = Front trap use trap 2nd shot
1 – roll of 3, 6 = Excellent drive 70
3 – repeat of 3 = Short
3 – roll of 1, 6 = Excellent drive
6 – repeat of 6 = Short
6 – roll of 1, 3 = Excellent drive

2nd hole

1st roll was
2 – repeat of 2 = Beyond excellent
2 – roll of 3, 6 = Excellent drive
3 – repeat of 3 - Excellent drive
3 – roll of 2, 6 = Average drive
6 – repeat of 6 = Beyond excellent
6 – roll of 2, 3 = Excellent drive
2, 3, 6 – roll of 1, 4, 5 = In water (tee off again)

3rd hole

1st roll was
2 – repeat of 2 = Automatic birdie (2)
2 – roll of 6 = Green 10 ft.
6 – repeat of 6 = Green 10 ft.
6 – roll of 2 = Green 10 ft.
2, 6 – roll of 1, 3, 4, 5 = Same as chart

4th hole

1st roll was
1 – repeat of 1 = Front trap
1 – roll of 3, 6 = Excellent drive
3 – repeat of 3 = Beyond excellent
3 – roll of 1, 6 = Excellent drive
6 – repeat of 6 = Beyond excellent
6 – roll of 1, 3 = Excellent drive
1, 3, 6 – roll of 2, 4, 5 = Same as chart

5th hole

1st roll was
2 – repeat of 2 = Automatic birdie
2 – roll of 6 = Green 10 ft.
6 – repeat of 6 = Green 10 ft.
6 – roll of 2 = Green 10 ft.
2, 6 – roll of 1, 3 = Same as chart
2, 6 – roll of 4, 5 = In water

6th hole

1st roll was
1 – repeat of 1 = Excellent drive
1 – roll of 3, 6 = Average drive
3 – repeat of 3 = Beyond excellent
3 – roll of 1, 6 = Excellent drive
6 – repeat of 6 = Beyond excellent
6 – roll of 1, 3 = Excellent drive
1, 3, 6 – roll of 2, 4, 5 = Same as chart

7th hole

1st roll was
2 – repeat of 2 = Beyond excellent
2 – roll of 3, 6 = Excellent drive
3 – repeat of 3 = Excellent drive
3 – roll of 2, 6 = Average drive
6 – repeat of 6 = Beyond excellent
6 – roll of 2, 3 = Excellent drive
2, 3, 6 – roll of 1, 5 = In center trees use poor 2nd shot
2, 3, 6 – roll of 4 = Same as chart

8th hole

1st roll was
1 – repeat of 1 = Right trap
1 – roll of 3, 6 = Excellent drive
3 – repeat of 3 = Beyond excellent
3 – roll of 1, 6 = Excellent drive
6 – repeat of 6 = Beyond excellent
6 – roll of 1, 3 = Excellent drive
1, 3, 6 – roll of 2, 4, 5 = Same as chart

9th hole

1st roll was
1 – repeat of 1 = Left trap
1 – roll of 3, 6 = Excellent drive
3 – repeat of 3 = Beyond excellent
3 – roll of 1, 6 = Excellent drive
6 – repeat of 6 = Beyond excellent
6 – roll of 1, 3 = Excellent drive
1, 3, 6 – roll of 1, 4 = Fairway trap use average 2nd shot
1, 3, 6 – roll of 5 = Same as chart

10th hole

1st roll was
1 – repeat of 1 = Excellent drive 70
1 – roll of 3, 6 = Average drive
3 – repeat of 3 = Beyond excellent
3 – roll of 1, 6 = Excellent drive
6 – repeat of 6 = Beyond excellent
6 – roll of 1, 3 = Excellent drive
1, 3, 6 – roll of 2, 4 = In water - 1 stroke penalty use poor 2nd shot
1, 3, 6 – roll of 5 = Same as chart

11th hole

1st roll was
2 – repeat of 2 = Automatic birdie
2 – roll of 6 = Green 10 ft.
6 – repeat of 6 = Green 10 ft.
6 – roll of 2 = Green 10 ft.
2, 6 – roll of 3, 4 = Left trees use approach 2nd shot
2, 6 – roll of 1,5 = Same as chart

Fig. 4.

12th hole

1st roll was
1 – repeat of 1 = Excellent drive
1 – roll of 3, 6 = Excellent drive
3 – repeat of 3 = Beyond excellent
3 – roll of 1, 6 = Excellent drive
6 – repeat of 6 = Green 30 ft.
6 – roll of 1, 3 = Excellent drive
1, 3, 6 – roll of 2,4 = Poor drive
1, 3, 6 – roll of 5 = Same as chart

13th hole

1st roll was
1 – repeat of 1 = Excellent drive
1 – roll of 3, 6 = Average drive
3 – repeat of 3 = Beyond excellent
3 – roll of 1, 6 = Excellent drive
6 – repeat of 6 = Beyond excellent
6 – roll of 1, 3 = Excellent drive
1, 3, 6 – roll of 2, 4 = In water - 1 stroke penalty - use poor 2nd shot
1, 3, 6 – roll of 5 = Same as chart

14th hole

1st roll was
2 – repeat of 2 = Automatic birdie
2 – roll of 6 = Green 10 ft.
6 – repeat of 6 = Green 10 ft.
6 – roll of 2 = Green 10 ft.
2, 6 – roll of 1, 4 = Short
2, 6 – roll of 3, 5 = Trap

15th hole

1st roll was
2 – repeat of 2 = Beyond excellent
2 – roll of 3, 6 = Excellent drive
3 – repeat of 3 = Left fairway trap
3 – roll of 2, 6 = Excellent drive
6 – repeat of 6 = Beyond excellent
6 – roll of 2,3 = Excellent drive
2, 3, 6 – roll of 1, 4 = Left trees
2, 3, 6 – roll of 5 = Same as chart

16th hole

1st roll was
1 – repeat of 1 = Beyond excellent
1 – roll of 3, 6 = Excellent drive
3 – repeat of 3 = Green 30 ft.
3 – roll of 1, 6 = Excellent drive
6 – repeat of 6 = Green 20 ft.
6 – roll of 1, 3 = Excellent drive
1, 3, 6 – roll of 2, 4 = Right trees
1, 3, 6 – roll of 5 = Same as chart

17th hole

1st roll was
1 – repeat of 1 = Excellent drive
1 – roll of 3, 6 = Excellent drive
3 – repeat of 3 = Beyond excellent
3 – roll of 1, 6 = Excellent drive
6 – repeat of 6 = Beyond excellent
6 – roll of 1, 3 = Excellent drive
1, 3, 6 – roll of 2,4 = Right trees
1, 3, 6 – roll of 5 = Same as chart

18th hole

1st roll was
2 – repeat of 2 = Beyond excellent
2 – roll of 3, 6 = Excellent drive
3 – repeat of 3 = Excellent drive
3 – roll of 2, 6 = Excellent drive
6 – repeat of 6 = Beyond excellent
6 – roll of 2, 3 = Excellent drive
2, 3, 6 – roll of 1, 4 = In water - 1 stroke penalty - use poor 2nd shot
2, 3, 6 – roll of 5 = Same as chart

GOLF GAME

BACKGROUND OF THE INVENTION

This invention relates to board games and more particularly to a board game which simulates the sport of golf.

A number of simulated golf games have previously been introduced. However, most such games, in an effort to simulate every mental step taken during the sport of golf, are very elaborate and complex, making them difficult to learn and play, particularly for the golf novice. Additionally, prior golf games include several separate pieces, which may be lost or broken and which increase the costs of production. For example, U.S. Pat. No. 3,910,501 issued to Nicholson discloses a golf game in which markers are moved precise incremental distances from tee to green on each golf hole displayed on a board. Dice and several spinners, one for each golf hole and each type of stroke, are provided for advancing to markers. U.S. Pat. No. 3,944,229 issued to Feeney discloses a similar game in which one or more of several dice are thrown to determine the location of the golf ball, and several cards are provided to give the results of a player's shot from sand traps.

BRIEF SUMMARY OF THE INVENTION

The present invention is much less complex than prior golf games in both construction and use, while including the basic elements of golf. The game also permits optional strategies to be applied which marginally increase the complexity of the game without requiring substantial knowledge of the actual sport of golf.

The golf game of the present invention includes (1) a board carrying a pictorial representation of a multi-hole golf course, (2) markers for marking the position of each player's golf ball on the golf course, (3) charts displaying verbal and numerical indicia of various positions on the golf holes and (4) a chance selection device, such as a die, for selecting indicia on the charts and moving the markers to the positions on the golf course corresponding to these indicia.

The golf course includes par 3, par 4 and par 5 holes, each having a tee, a fairway, one or more hazards such as water, sand traps and trees, and a green. The greens and fairways are marked to distinguish various areas thereof corresponding to various shots made, e.g. short or long drives, various degrees of closeness to the pin on the green, etc. The holes displayed on the board are distinct and do not all include the same hazards. For example, a particular hole may have only sand traps or it may have only a water hazard. A basic set of charts and the die are used for advancing the markers between the various fairway, hazard and green areas marked on each hole. One chart is provided for par 3 holes, a second chart is provided for par 4 holes and a third chart is provided for par 5 holes. In accordance with one method of playing the game only this set of basic charts is utilized and, the variety of play of the game is provided by the differences in the charts corresponding to the holes of different par values. Play also can be varied by not applying on individual hole indica of hazards disposed on the corresponding charts which are not shown on the pictorial representation of the individual holes. However, play is maintained uncomplicated by having only three charts which show exactly where the ball is to be advanced after each throw of the die.

In accordance with another feature of the invention, a second set of charts (one chart for each hole) is provided so that features of individual holes on the course may be more directly taken into account when advancing the ball. Indicia are provided on the second set of charts which represent various positions to which the ball should be advanced on individual holes. In one exemplary alternative method of playing the game the second set of charts are referred to, superceding play in accordance with the first set of charts, following a second roll of the die when permitted by the rules of the game. By establishing indicia on these second charts which are in some manner representative of the probabilities of given golf shots from a given location on given holes, the provision of a second set of charts provides the possibility of introducing into the game player discretion based on knowledge of probabilities in the sport of golf.

BRIEF DESCRIPTION OF THE DRAWINGS

Additional aspects of the present invention will become readily apparent from the following detailed description of the preferred embodiments thereof and the accompanying drawings in which:

FIGS. 2*a*, 2*b*, and 2*c* are enlarged views of representative golf holes on the golf course shown in FIG. 1;

FIGS. 3*a*, 3*b*and 3*c* are plan views of a first series of charts from which results are obtained;

FIG. 4 is a plan view of a portion of a second series of charts which optional play results are obtained.

DETAILED DESCRIPTION OF THE PREFERRED EMBODIMENT

Figure 1:
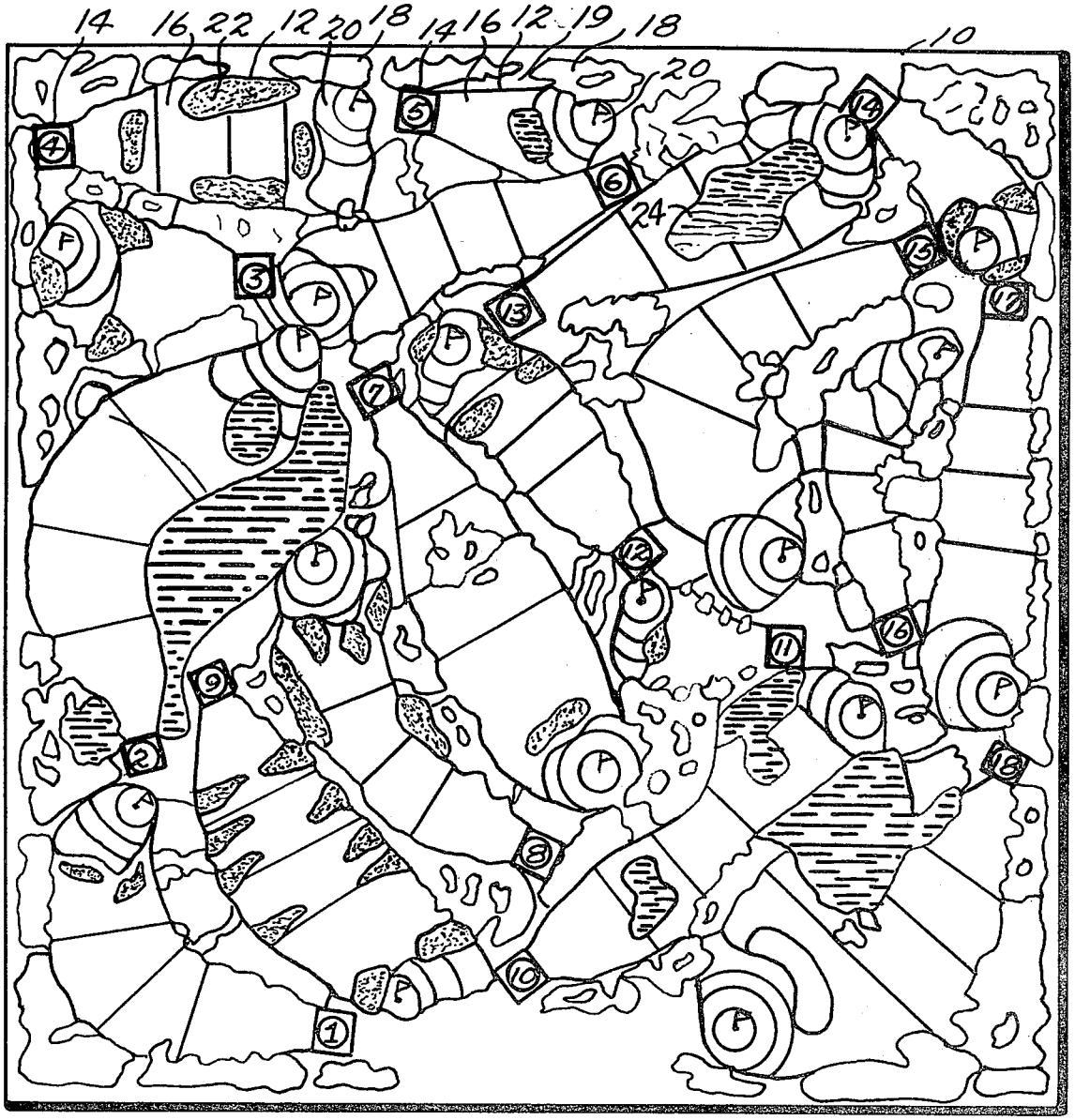
FIG. 1 is a plan view of a game board incorporating a reduced scale representation of a golf course.

Referring first to FIG. 1, there is shown an overall view of the game board 10. It shows a regulation 18 holes golf course. Each of the golf holes 12 are laid out as they might be on a real golf course and include a tee area 14, a fairway 16, trees 18, rough 19, a green 20, and may include sand traps 22 and/or water hazards 24. The course includes par 3, and par 5 holes of varying shape and length. The overall shape of the holes, including the location and shape of the greens, and of hazards such as sand traps and water, are clearly shown exactly as they would be encountered on a conventional golf course.

Figure 2C:
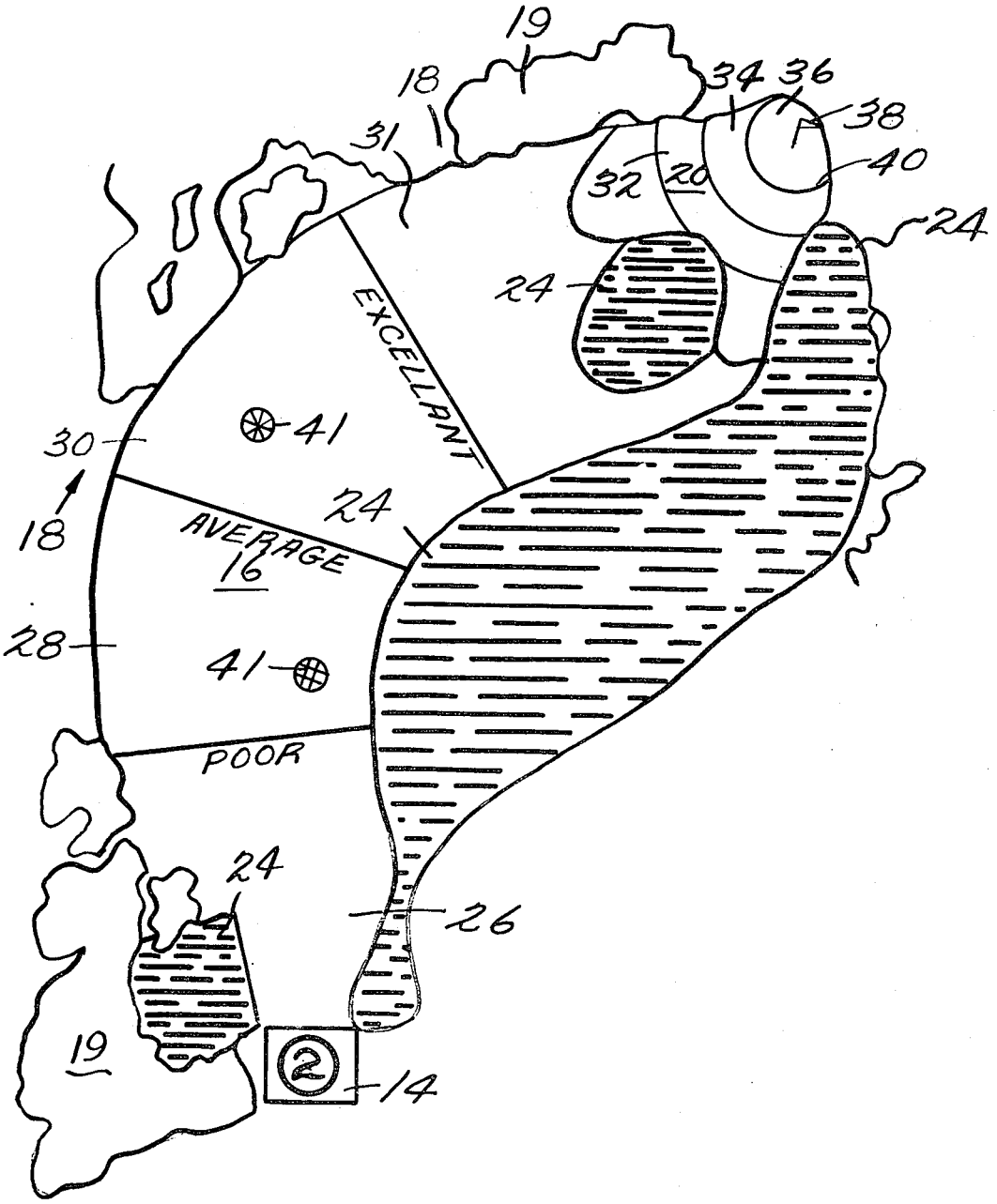

FIGS. 2*a*, 2*b*, and 2*c* show enlarged views of three representative holes (the par 3 third hole, the par 4 first hole and the par 5 second hole, respectively). As discussed above, each hole is divided into several areas including a tee 14, faiway 16, green 20, and hazard areas such as rough 18, trees 19, sand traps 22 and water 24. The presence of sand traps and water hazards vary from hole to hole while trees and rough line every hole on the course. The fairways on par 4 and par 5 holes are divided into a number of areas 26, 28 and 30, corresponding to different length drives from the tees, and an "approach" area 31 adjacent to the green 20. In the examplary embodiment, par 4 and 5 holes include 3 areas marked "poor, " "average" and "excellent," reflecting the quality of drives into those areas. The fairways on par 3 holes are not so divided since par 3 fairways are conventionally short and the tee shot would ordinarily reach the green 20 or approach area 31. Greens 20 on each hole are divided into areas 32, 34 and 36, reflecting distances of 10, 20 and 30 feet from the pin. These areas marked by concentric arcs 40 centered at pin 38. Exemplary movable markers 41, for marking the location of the ball, are also shown.

Figure 5:
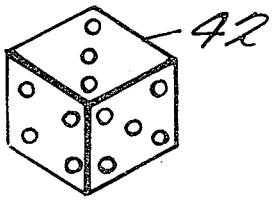
FIG. 5 is a die used as the chance selection means for the present invention.

In order to advance the ball from the tee 14 to the pin 38, a chance selection device such as a die 42, shown in FIG. 5, and a series of charts 44, 46 and 48, respectively shown in FIGS. 3*a*, 3*b* and 3*c*, are utilized. The charts may be displayed on one card or three separate cards. The three charts 44, 46 and 48 respectively include first columns 50, 52 and 54 of indicia entries descriptive of the various areas from which a shot is to be taken on each par 3, par 4, or par 5 hole. Across from the first column on each chart are six numbered columns respectively corresponding to the six possible "shots," i.e., rolls of the die 42. Each of these six columns includes a plurality of indicia entries, each entry corresponding for a given roll of the die 42 to an individual area on the hole to which the ball should be advanced from the area at which it is originally located. For example, entry 56 in column 58 of chart 46, corresponds to a shot from the approach area to within 10 feet of the pin on a par 4 hole.

The charts 44, 46 and 48 are respectively designed to correspond to the different difficulties of reaching the pin on par 3, par 4 and par 5 holes on regulation golf courses. Thus, referring to par 3, chart 44, the first column 50 lists shots from the tee, shots from the approach area to the green, shots from the sand traps, and putts from 10, 20 and 30 feet from the pin on the green. Across from the top three indicia entries in the first column 50 of chart 44, corresponding to shots locations not on the green, are various indicia entries of locations the ball could land after the shots. For example, across from the designation "TEE SHOTS" in column 50 are a plurality of indicia entries 62, respectively indicating that the shot went in the sand trap, on the green 10 feet from the pin, on the green 30 feet from the pin, in a water hazard, short of the green in the approach area, and on the green 20 feet from the pin. The indicia entries 64 for shots on the green are indicated to the right of the bottom three in column 50. Indicia entries 64 correspond to putts from different areas on the green, and indicate a number of putts needed to advance the ball to the pin. In a typical sequence of shots on a par 3 hole, the tee shot will either land on the green, "short" from which an "approach shot" will be taken or into a sand trap which a "trap shot" may be taken. Next, either a "trap shot" or an "approach shot" will result in the ball landing on the green, and then either one, two or three putts will be taken for the ball to reach the pin.

The indicia provided on chart 46, corresponding to par 4 holes, are arranged so that more shots will generally be required to reach the pin on par 4 holes than on par 3 holes. The left hand column 52 includes indicia of essentially the same locations on the hole as the par 3 left hand column 50, but in addition provides indicia entries corresponding to areas on the fairway corresponding to "poor", "average" and "excellent" drives from the tee. Second shots from the areas on the fairway corresponding to poor, average and excellent drives are required in order to reach the approach area, sand traps and green. Par 5 chart 48 is similar in format to par 4 chart 46 but the possibilities of reaching the green in a given number of shots are more limited for the par 5 holes. For example, as is shown on charts 46 and 48, five of the six second shots after "excellent drives" will land the ball on the green of a par 4 hole, but only three of six second shots following an excellent drive will land on the green on a par 5 hole.

The game may be played solely with the parts heretofore described, or in accordance with another aspect of the invention a separate chart 66 shown in FIG. 4 may be utilized. Chart 66 may be displayed on one or several cards. Chart 66 is provided in order to permit a player to optionally roll a second time in order to determine the result of a given shot. In accordance with an exemplary set of rules which are further described below for the particular embodiment shown, the player is permitted to optionally roll a second time on a tee shot (drive) if the first roll has turned up one of certain specified numbers. These numbers are specified by an asterick (*) 72 marked in the "DRIVE" or "TEE SHOT" row of charts 44, 46 and 48. This alternate chart (or charts) 66 includes indicia entries 70 indicating for each individual hole the result of the shot, based on both the first and the second roll of die 42. The results of a second roll indicated on chart 66 may be more or less favorable than if the player accepts the results of the first roll indicated on charts 44, 46 an 48. For example, on the tenth hole, a first roll of 3 followed by a second roll of 3 indicates a drive "beyond excellent" which, in accordance with exemplary rules of the game, places the ball directly in the approach area 31 from which the player's second shot will be an "approach shot." On the other hand, a first roll of 1, 3 or 6 followed by a second roll 2 or 4 result in a one stroke penalty and a requirement that the third shot be taken from the "poor drives" area of the fairway. However, if in this case the player were to accept the first roll of the die for placement of his drive, the worst he could do would be a drive into the "poor drives" area, from which a second shot would be taken.

Also, the indicia entries 70 differ for each individual hole. Thus, the possible results of the second roll vary from hole to hole and the risks to be taken by a second roll also vary. This feature, then, introduces a requirement for player discretion or strategy as an element of the game. It should also be understood that while optional chart 66 introduces a variation in the play of only the first shot of each hole, similar charts could be provided for later shots as well.

Some or all of the rules of the game may be displayed on the game board and charts or in a separate pamphlet.

Exemplary Rules of the Game

In accordance with exemplary rules by which the game may be played without the use of optional chart 66, each player chooses a marker 41 to represent his ball and begins play at hole No. 1, a par 4. Each player in turn rolls die 42 and refers to par 4 chart 46 in order to determine where his drive has landed. After the drive, each player is in a "poor," "average" or "excellent" area on hole No. 1. Each player then takes a second shot be rolling the die 42 and referring again to chart 46 to determine where his shot has landed. Each player's second shot will, depending on the particular roll of the die, land either in a sand trap, short of the green, in a water hazard, or 10, 20 or 30 feet from the pin. In accordance with these exemplary rules, for his third shot, each player refers to the row marked "TRAPS SHOTS" if his second shot landed in a trap, refers to the row marked "APPROACH SHOTS" for a second shot landing "short," takes a one stroke penalty and refers to the row marked "APPROACH SHOTS" if his second shot landed in a water hazard, and refers to the 10, 20 or 30 foot putts row if his second shot landed on the green at 10, 20 or 30 feet from the pin. Following the conventional rules of golf, after all players are on the green, each player rolls and again refers to the "PUTTS" row on chart 46 to determine whether one, two or three strokes are needed to hole out. Upon completion of hole No. 1, play proceeds to hole No. 2, and since hole No. 2 is a par 5, the par 5 shot chart 48 is referred to in locating the ball after each shot, in the same manner that chart 46 was utilized on hole No. 1. Similarly, after hole No. 2 has been completed, the players proceed to utilize par 3 shot chart 44 in playing hole No. 3.

It will be noted that several holes on the game board 10 (such as hole Nos. 1, 2 and 3) do not include one or more of the hazards (water or sand traps). In accordance with the exemplary rules of the game, a player whose roll of the die indicates a hazard which is not shown on the hole he is playing, would simply roll again. Other rules could of course be alternatively utilized in such circumstances in order to increase the diversity of the game.

In accordance with a second exemplary set of rules for playing the present game, each player may for his first shot on each hole, depending on the result of his first roll, roll die 42 a second time and refer to chart 66 in order to determine the placement of his ball. In accordance with these rules, the option would present itself only if the number which turns up on the first roll of the die has an asterick 72 in the column beneath that number (in the "DRIVE" or "TEE SHOT" row of the appropriate shot chart 44, 46 or 48). Rules interpreting short-hand designations on chart 66 of what a particular roll of die 42 indicates as to the location of the shot, may be provided either in a separate rules pamphlet or on chart 66 itself. For example, the term "beyond excellent" which is indicated on chart 66 for a first roll of 2 followed by a second roll of 2 on hole No. 2, indicates that the second shot should be taken from the approach area 31 of the fairway (using the "APPROACH SHOTS" row on the appropriate shot chart). Similary, the designation "short" also indicates that the ball has landed in the approach area 31.

Although only the preferred embodiment of the golf game of the present invention is disclosed in detail above, for illustrative purposes, it will be understood that variations and modifications of the disclosure which fall within the scope of the appended claims are fully contemplated.

What is claimed is:

1. A golf game comprising:

a playing board carrying a pictorial configuration of a multi-hole course having associated with the holes tees, fairways, hazards, greens and pins on said greens;

at least one card having disposed thereon first indicia representing distinct areas on each hole on said playing board and second indicia corresponding to shots which advance a ball on each hole;

said first and second indicia being displayed in at least two charts respectively corresponding to at least two categories of said holes, said first indicia corresponding to each of said areas and said second indicia being correlated to said first indicia and corresponding to two or more different ones of said areas;

said at least one card having a plurality of sets of third indicia marked thereon, each set of third indicia corresponding to a different one of said holes, and to one or more of said second indicia, and a plurality of fourth indicia correlated to said third indicia and coreesponding to separate ones of at least two of said areas; and chance means for selecting one of said plurality of second and third indicia so as to advance said ball from one of said areas corresponding to one of said plurality of first indicia to another area corresponding to said one of said plurality of second and third indicia.

2. A golf game as in claim 1 wherein said at least one card has a plurality of markings disposed thereon adjacent one or more of said second indicia to which said third indicia correspond.

3. A golf game as in claim 1 wherein said at least one card comprises:

a first card, said plurality of first indicia and said plurality of second indicia both being disposed thereon; and a second card, said plurality of third and fourth indicia being disposed thereon.

4. A golf game as in claim 1 wherein said hazards include first and second categories of hazards respectively, and at least some of said holes having only one category of hazards.

5. A golf game as in claim 1 wherein the ones of said plurality of second indicia descriptive of shots from separate areas on said greens designate a number of shots needed to reach said pins on said greens.

6. A golf game comprising:

a playing board carrying a pictorial configuration of a multi-hole golf course having associated with the holes trees, fairways, hazards, greens and pins on said greens;

at least one card having disposed thereon first indicia representing distinct areas on each hole of said playing board and second indicia corresponding to shots which advance a ball on said each hole;

said first and second indicia being displayed on at least three charts respectively corresponding to at least three categories of said holes, said first indicia on said first chart including one indicia entry descriptive of shots from said tees, at least one indicia entry descriptive of shots from said hazards and at least two indicia entries descriptive of shots from separate areas on said greens, said first indicia on said second and third charts each including one indicia entry descriptive of shots from said tee, at least two indicia entries descriptive of shots from said separate areas on said fairways, at least one indicia entry descriptive of shots from said hazards and at least two indicia entries descriptive from separate areas on said greens, said second indicia being correlated to said first indicia and corresponding to two or more different ones of said areas;

said at least one card having a plurality of sets of third indicia marked thereon, each set of third indicia corresponding to a different one of said holes, each set of third indicia corresponding to one or more of said second indicia, and a plurality of fourth indicia correlated to said third indicia and corresponding to separate ones of at least two of said areas; and chance means for selecting one of said plurality of second indicia so as to advance said ball from one of said areas corresponding to one of said plurality of first indicia to another area corresponding to said one of said plurality of second indicia.

* * * * *